US008348722B2

(12) United States Patent
Arnold

(10) Patent No.: US 8,348,722 B2
(45) Date of Patent: Jan. 8, 2013

(54) MOWER BLADE SHARPENING DEVICE

(76) Inventor: Marion D. Arnold, Greenville, OH (US)

( * ) Notice: Subject to any disclaimer, the term of this patent is extended or adjusted under 35 U.S.C. 154(b) by 279 days.

(21) Appl. No.: 12/707,881

(22) Filed: Feb. 18, 2010

(65) Prior Publication Data

US 2011/0201258 A1 Aug. 18, 2011

(51) Int. Cl.
*B24B 1/00* (2006.01)

(52) U.S. Cl. ..... 451/45; 451/162; 451/419; 451/523

(58) Field of Classification Search ..... 76/82, 82.1; 451/162, 555, 415, 419, 439, 523, 45
See application file for complete search history.

(56) References Cited

U.S. PATENT DOCUMENTS

| | | | | | |
|---|---|---|---|---|---|
| 606,333 | A | * | 6/1898 | Doty | 76/88 |
| 1,187,554 | A | * | 6/1916 | Root | 451/421 |
| 1,391,702 | A | * | 9/1921 | Stone | 451/419 |
| 1,749,306 | A | * | 3/1930 | Snow | 76/82.1 |
| 2,076,311 | A | * | 4/1937 | White | 451/423 |
| 2,347,864 | A | | 5/1944 | Wulff | |
| 2,377,984 | A | | 6/1945 | Ward | |
| 2,378,179 | A | * | 6/1945 | Brooks | 76/82.1 |
| 2,513,591 | A | * | 7/1950 | Silfen | 76/82.1 |
| 2,613,483 | A | | 10/1952 | Lewis et al. | |
| 2,728,176 | A | * | 12/1955 | Ritzert | 451/419 |
| 2,826,032 | A | * | 3/1958 | Hayes | 56/255 |
| 2,928,215 | A | | 3/1960 | McDonald | |
| 2,976,602 | A | * | 3/1961 | Nelson | 407/29.15 |
| 3,136,107 | A | | 6/1964 | Spear | |
| 3,225,527 | A | | 12/1965 | Spear | |
| 3,331,167 | A | * | 7/1967 | Hoch | 451/419 |
| 3,800,480 | A | | 4/1974 | Keating | |
| 3,826,159 | A | | 7/1974 | Otto | |
| 4,285,169 | A | | 8/1981 | Franklin | |
| 4,418,588 | A | | 12/1983 | Byers | |
| 4,564,991 | A | | 1/1986 | Taylor | |
| 4,882,960 | A | | 11/1989 | Kugler | |
| 5,062,322 | A | | 11/1991 | Sinko | |
| 5,159,784 | A | | 11/1992 | Varner, Sr. et al. | |
| 5,371,977 | A | | 12/1994 | Liner | |
| 5,545,079 | A | * | 8/1996 | Larsson et al. | 451/342 |
| 5,725,415 | A | | 3/1998 | Bernhard | |
| 5,893,792 | A | * | 4/1999 | Scott | 451/45 |
| 6,039,642 | A | | 3/2000 | Collins | |
| 6,261,161 | B1 | * | 7/2001 | Yan | 451/70 |
| 6,666,758 | B1 | | 12/2003 | Parrott | |
| 6,817,269 | B1 | | 11/2004 | Grace, Jr. | |
| 7,001,259 | B1 | | 2/2006 | Wu | |
| 7,066,796 | B2 | | 6/2006 | Pfaus | |
| 7,229,344 | B1 | | 6/2007 | Wu | |
| 7,374,475 | B2 | | 5/2008 | Byers | |
| 2005/0245175 | A1 | | 11/2005 | Combs | |
| 2008/0096477 | A1 | | 4/2008 | Lytinas | |

* cited by examiner

*Primary Examiner* — George Nguyen
(74) *Attorney, Agent, or Firm* — W. Charles Ehlers; Hasse & Nesbitt LLC

(57) ABSTRACT

A mower blade sharpening device comprising a guide body having a sharpening rod guide, a sharpening rod having a sharpener end, and an operator end. The sharpening rod is disposed in the sharpening rod guide. A sharpener is disposed on the sharpener end of the sharpening rod. Also disclosed is a method for sharpening a mower blade using the sharpening device.

3 Claims, 7 Drawing Sheets

MOWER BLADE SHARPENING DEVICE

FIELD OF THE INVENTION

This invention relates to a device for sharpening mower blades and more specifically to a device for sharpening a mower blade without removing the mower blade from a mower.

BACKGROUND OF THE INVENTION

Mower blades should be sharpened on a regular basis to operate properly and to maintain a healthy lawn. Typically, mower blades are sharpened by removing the blade, mounting it on a fixture, sharpening the blade and reinstalling the blade. Removing blades can be difficult, time consuming, and dangerous. The bolt holding the blade may become corroded and difficult to remove because of the moist environmental conditions under a mower deck that grass cutting creates. Additionally, a method of keeping the blade from rotating while loosening the blade bolt is necessary, and attempting to hold the blade with one's hand while loosening the bolt is dangerous, and may cut fingers.

Sharpening a mower blade while it remains installed on a mower would alleviate the above mentioned problems associated with sharpening a mower blade.

SUMMARY OF THE INVENTION

The invention relates to a mower blade sharpening device comprising a guide body, wherein said guide body includes a sharpening rod guide, a sharpening rod having a sharpener end and an operator end, wherein said sharpening rod is disposed in said sharpening rod guide, and a sharpener disposed on said sharpener end of said sharpening rod.

The invention also relates to a mower blade sharpening device comprising a guide body, wherein said guide body includes a sharpening rod guide and a clamp, a sharpening rod having a sharpener end and an operator end, wherein said sharpening rod is disposed in said sharpening rod guide, and a sharpener disposed on said sharpener end of said sharpening rod.

The invention further relates to a method for sharpening a mower blade, comprising providing a guide body, said guide body comprising a sharpening rod guide and a clamp, providing a sharpening rod having a sharpener end and an operator end, wherein said sharpening rod is dispose in said sharpening rod guide, and wherein a sharpener is disposed on said sharpener end of said sharpening rod, securing said guide body to a mower, and sharpening a mower blade with a sharpener.

DETAILED DESCRIPTION OF THE INVENTION

Figure 1:
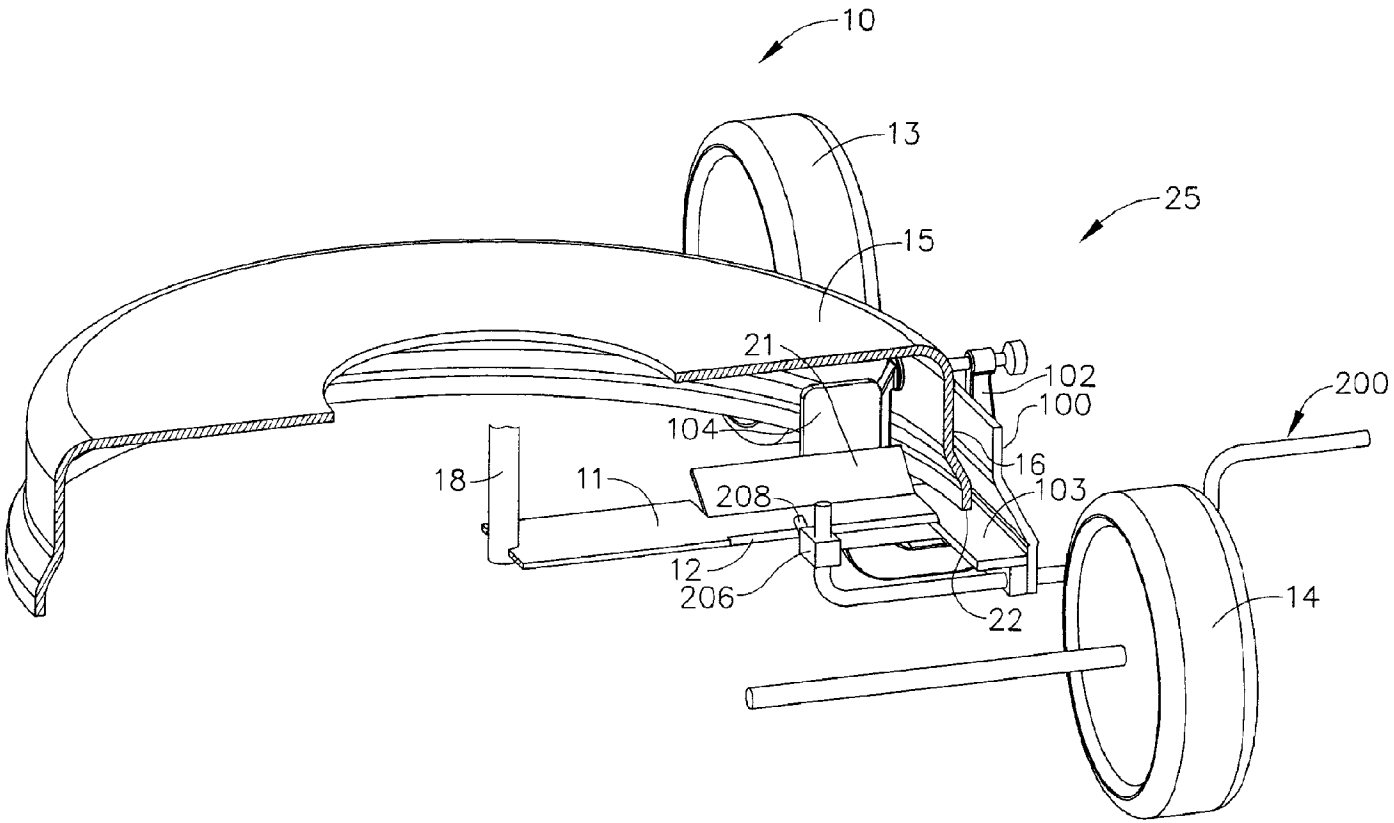
FIG. 1 is a perspective view of a mower blade sharpening device of the invention mounted to a mower deck.
Figure 7:
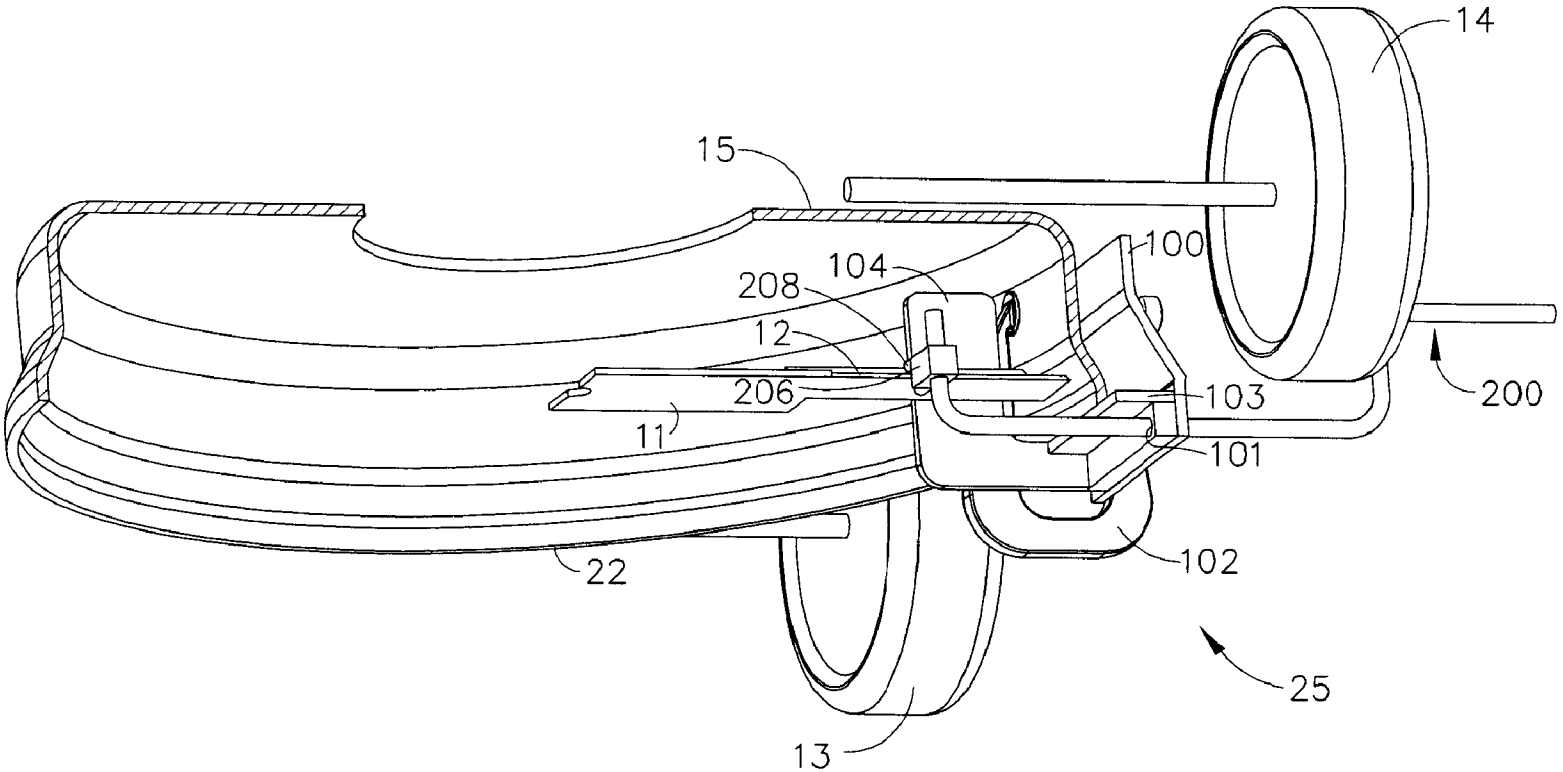
FIG. 7 is a different perspective view of the device of FIG. 1.

FIG. 1 depicts a lawn mower 10, having wheels 13 and 14, a mower deck 15, and a mower deck side 16. In the grass-cutting operation, an engine (not shown) rotationally drives a shaft 18 to which a mower blade 11 is attached. Mower blade 11 has a cutting edge 12, which cuts grass as the blade rotates. FIG. 1 and FIG. 7 show a sharpening device 25 of the invention mounted in its sharpening position to the mower deck side 16.

Figure 3:
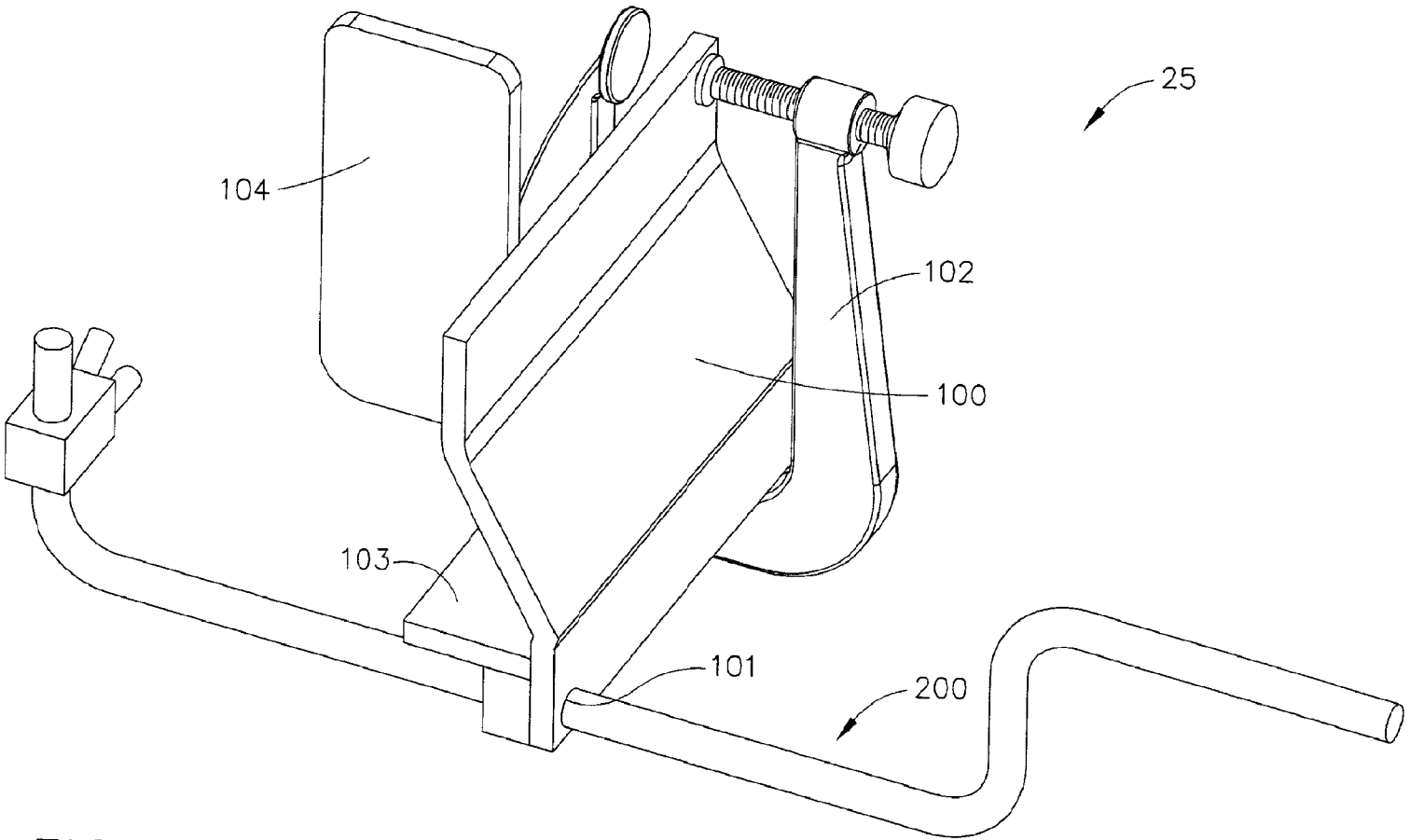
FIG. 3 is an enlarged perspective view of the mower blade sharpening device of FIG. 1.
Figure 6:
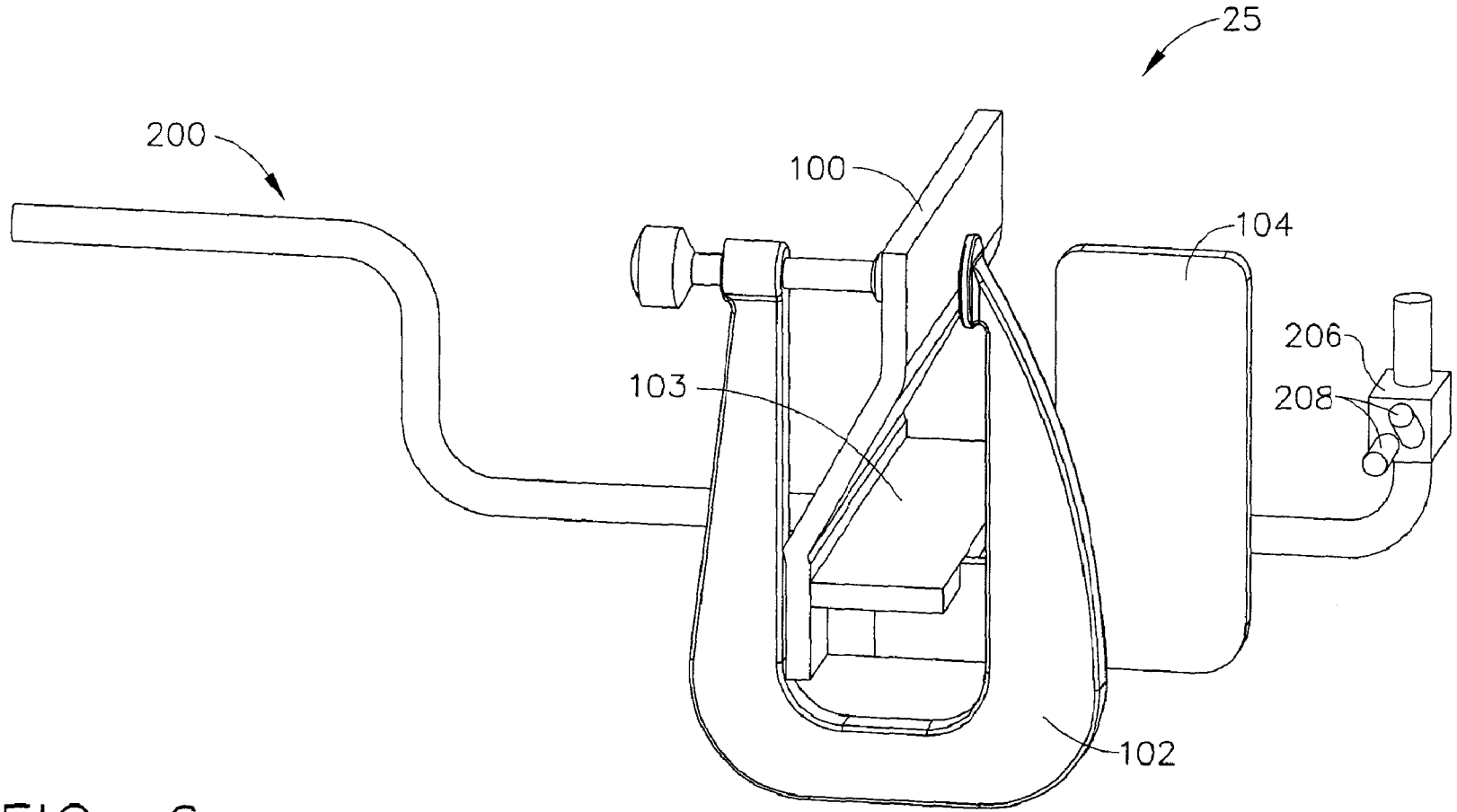
FIG. 6 is another perspective view of the device of FIG. 3.

Referring now to FIG. 3 and FIG. 6, the sharpening device 25 has a guide body 100, a securing mechanism 102 for securing the sharpening device 25 to a mower deck, and a sharpening rod assembly 200. The guide body 100 has a sharpening rod guide hole 101, a positioning flange 103 for locating the guide body 100 against the lower edge of a mower deck, and a blade stop 104.

Figure 4:
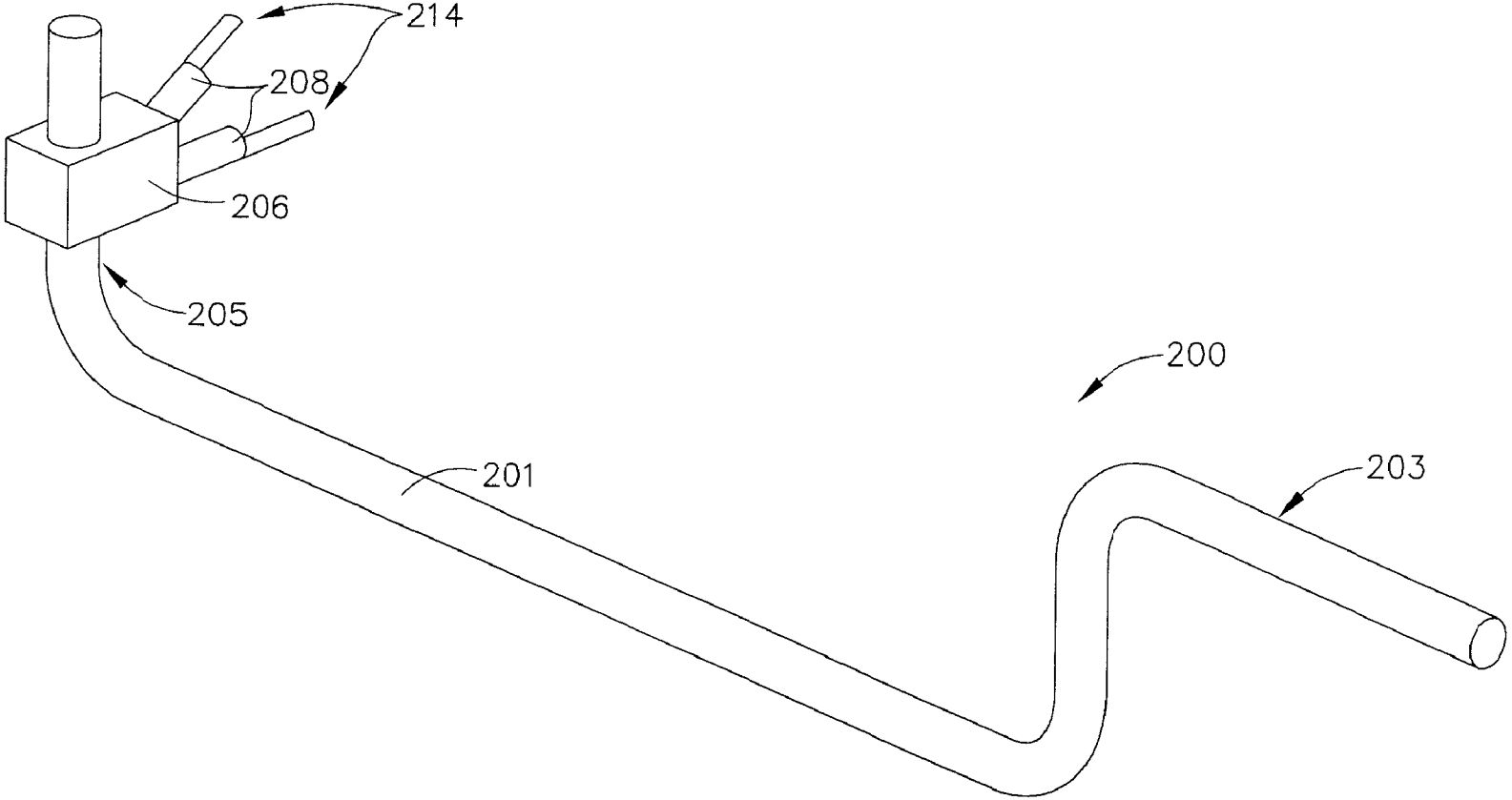
FIG. 4 is a perspective view of the sharpening rod assembly shown in FIG. 3.

In FIG. 4, the sharpening rod assembly 200 has a sharpening rod 201 with an operator end 203 and a sharpening end 205. The sharpening rod 201 may be constructed of metal, fiberglass, or other suitable materials. A sharpener holding assembly 206 having a sharpener 208 is affixed to the sharpening end 205. The sharpener 208 can be made from a variety of materials that may be used to sharpen lawn mower blades. For example, the sharpener 208 may be at least one carbide blade, sharpening stone, or file, among others. The sharpener holding assembly 206 may also have a guiding assembly, such as guide rods 214, to allow an operator to more easily align the sharpener 208 with the cutting edge 12 of the blade 11. Additionally, the sharpener holding assembly 206 may also include a power driven sharpener such as a grinder.

Figure 5:
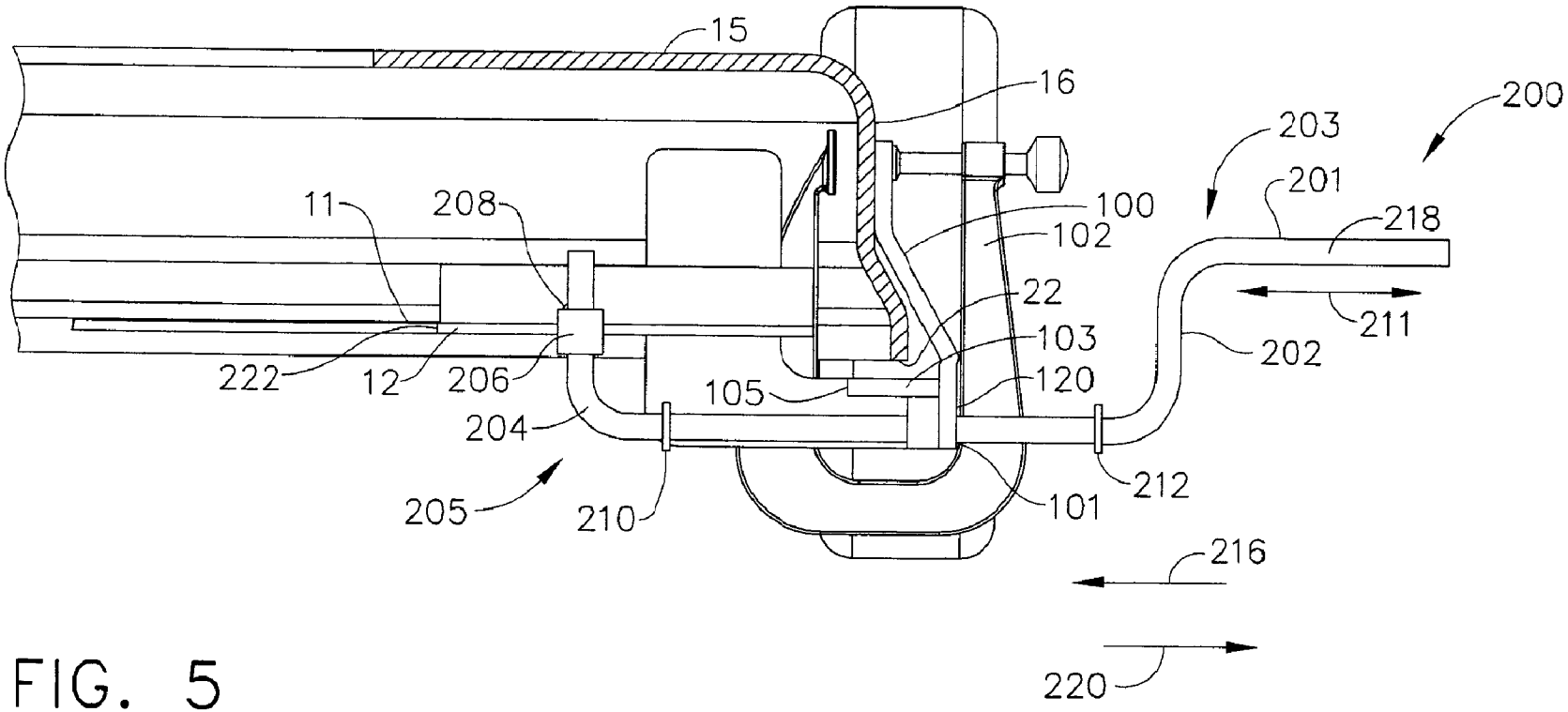
FIG. 5 is a view of a mower blade sharpening device of the invention mounted to a cut away section of a mower deck.

As shown in FIG. 5, the sharpening rod 201 has an upwardly bent section 202 in the general vicinity of the operator end 203. As an operator pushes the operator end 203 toward the mower deck 15 in the direction of arrow 216, the sharpener 208 travels along the cutting edge 12 of the blade 11 thereby sharpening the cutting edge of the blade. When the upwardly bent section 202 contacts outside edge 120 of the guide body 100, it prevents further inward travel of the sharpening rod 201. Additionally, the upwardly bent section 202 creates an elevated gripping section 218 on the operator end 203 of the sharpening rod 201 which is above the sharpening rod guide hole 101 and the lower edge 22 of the mower deck. The elevated gripping section 218 allows the operator to grasp and then move the sharpening rod 201 back and forth in the direction shown by double-headed arrow 211 without scraping one's hand on the ground. The upwardly bent section 202 may be created by a variety of methods. For example, the upwardly bent section 202 may be constructed of at least two pieces affixed together, or it may be constructed by bending a single rod as is shown in FIG. 5. Also, the inward travel of the sharpening rod 211 in the direction of arrow 216 may be limited by a stop 212 affixed to the sharpening rod between the upwardly bent section 202 and the upwardly bent section 204.

The sharpening end 205 of the sharpening rod 201 also has an upwardly bent section 204. The upwardly bent section 204 allows the sharpener 208 to reach the cutting edge 12 of the mower blade 11, which is typically above the lower edge 22 of the mower deck. The upwardly bent section 204 also limits the outward travel of the sharpening rod 201 when it contacts the front edge 105 of the positioning flange 103 at the end of the pulling stroke shown by arrow 220. Other methods may also be utilized to create the upward bent section 204. For example, the sharpening end 205 could be constructed of at least two pieces affixed together to create the upward bent section 204. Moreover, the outward travel of the sharpening rod 201 may also be limited by a stop 210 affixed to the sharpening rod between the upwardly bent section 204 and the upwardly bent section 202. The upwardly bent sections 204 and 202, or stops 210 and 212, allow an operator to move the sharpening rod 201 quickly back and forth, as shown by double-headed arrow 211, without having the sharpener 208 hit the cutting edge blade interface 222 or slip off of the end of the blade 11.

Figure 2:
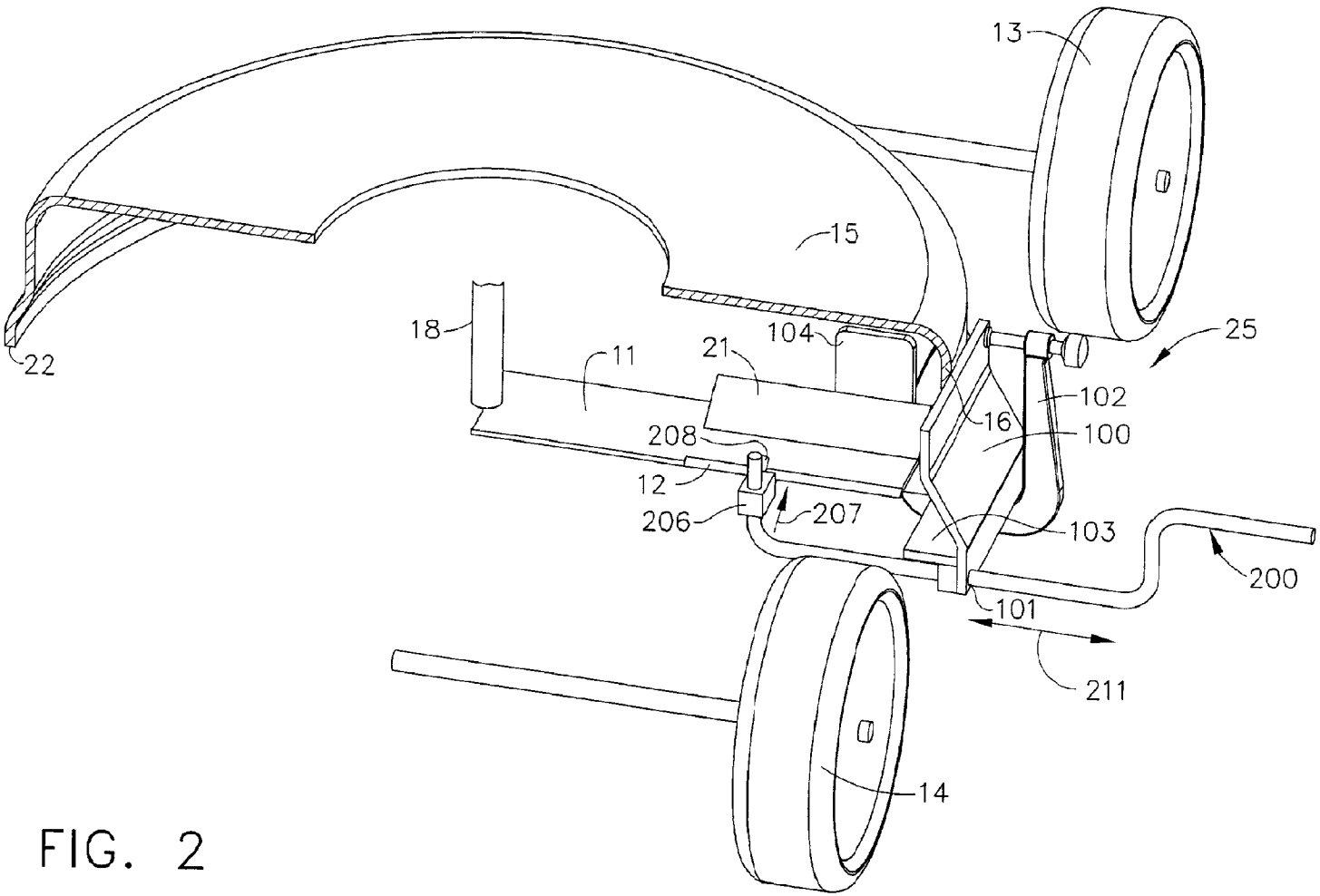
FIG. 2 is another perspective view of the device of FIG. 1.

To sharpen a mower blade, the guide body 100 of the sharpening device 25 can be attached to the side 16 of a mower deck 15 using a securing mechanism 102 as shown in FIG. 2. The securing mechanism 102 may be a C-clamp, a spring clamp, or any other clamping or affixing method which is suitable for removably affixing the guide body 100 to the mower deck side 16. A positioning flange 103 contacts the lower edge 22 of the side 16 of the mower deck 15, (FIG. 5). The positioning flange 103 allows the operator to easily establish the proper vertical location of the sharpening device relative to the blade 11 and the mower deck side 16. The operator slides the sharpening device 25 upward until the positioning flange 103 contacts the lower edge 22 of the mower deck side 16. When the positioning flange contacts the lower edge of the mower deck side, then the operator knows that the sharpening device is located in its sharpening position with respect to the bottom of the mower deck and the blade and the operator then secures the sharpening device with the securing mechanism.

Referring to FIG. 2, the sharpening rod assembly 200 slides in the sharpening rod guide hole 101. Alternatively, other methods instead of a hole may also be used as a sharpening rod guide. For example, a notch in the lower edge of the guide body 100 may be used as a sharpening rod guide. Moving the sharpening assembly 200 back and forth, as shown by double-headed arrow 211, causes the sharpener 208 on the sharpener holding assembly 206 to ride against the mower blade cutting edge 12, removing material and sharpening the mower blade cutting edge 12. The blade sharpening may occur during the push stroke as indicated by arrow 216, may occur during the pull stroke as indicated by arrow 220, or may occur during both the push and the pull stroke, (FIG. 5). One factor that can affect whether the blade sharpening occurs during the push stroke, pull stroke, or both is the type of material used for the sharpener. Some sharpening materials sharpen better when they are pushed along a blade, some sharpening materials sharpen better when they are pulled along a blade, and some sharpening materials sharpen well in both the push and pull directions. A blade stop 104 prevents the mower blade 11 from rotating away from the sharpener 208 as the sharpener pushes against the cutting edge 12 in the direction of arrow 207 during the sharpening process. Additionally, the blade stop 104 serves as a safety device to prevent the blade 11 from rotating and possibly causing the engine from starting while the operator is sharpening the mower blade.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus and method, and illustrated examples shown and described. Accordingly, departures may be made from such details without departing from the scope or spirit of the invention.

What is claimed is:

1. A mower blade sharpening device comprising:

a guide body, wherein said guide body includes a sharpening rod guide;

a sharpening rod having a sharpener end and an operator end, wherein said sharpening rod is disposed in said sharpening rod guide;

a sharpener disposed on said sharpener end of said sharpening rod; and wherein said guide body further comprises a blade stop.

2. A mower blade sharpening device comprising:

a guide body, wherein said guide body includes a sharpening rod guide and a clamp;

a sharpening rod having a sharpener end and an operator end, wherein said sharpening rod is disposed in said sharpening rod guide;

a sharpener disposed on said sharpener end of said sharpening rod; and wherein said clamp is a C-clamp.

3. A mower blade sharpening device comprising:

a guide body, wherein said guide body includes a sharpening rod guide and a clamp;

a sharpening rod having a sharpener end and an operator end, wherein said sharpening rod is disposed in said sharpening rod guide;

a sharpener disposed on said sharpener end of said sharpening rod; and wherein said sharpening rod guiding device further comprises a blade stop.

* * * * *